US006265680B1

(12) United States Patent
Robertson

(10) Patent No.: US 6,265,680 B1
(45) Date of Patent: Jul. 24, 2001

(54) ELECTRICAL CIRCUIT BREAKER HAVING AN INSULATION DISPLACEMENT CONNECTOR ASSEMBLY

(75) Inventor: James William Robertson, Harrisburg, PA (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/454,472

(22) Filed: Dec. 3, 1999

Related U.S. Application Data

(60) Provisional application No. 60/118,251, filed on Feb. 2, 1999.

(51) Int. Cl.[7] ..... H01H 1/64
(52) U.S. Cl. ..... 200/293; 439/810
(58) Field of Search ..... 200/51 R, 293; 439/810–814

(56) References Cited

U.S. PATENT DOCUMENTS

| | | | | |
|---|---|---|---|---|
| 3,818,168 | * | 6/1974 | Norden | 200/153 G |
| 4,151,386 | * | 4/1979 | Nicol et al. | 200/303 |
| 4,609,898 | * | 9/1986 | Seymour et al. | 335/202 |
| 5,006,077 | | 4/1991 | Loose et al. | 439/409 |
| 5,245,305 | * | 9/1993 | Ricker | 335/202 |
| 5,362,933 | * | 11/1994 | Kutsche et al. | 200/401 |
| 5,496,192 | | 3/1996 | Hower et al. | 439/409 |
| 5,641,312 | * | 6/1997 | Bippus et al. | 439/709 |
| 5,667,402 | | 9/1997 | Denovich et al. | 439/409 |
| 6,007,367 | * | 12/1999 | Gehbauer et al. | 439/402 |
| 6,088,219 | * | 7/2000 | Yanniello et al. | 361/657 |
| 6,111,745 | * | 8/2000 | Wilkie, II et al. | 361/605 |

OTHER PUBLICATIONS

Introduction to AMP Insulation Displacement Technique and Products (HB 5351 Rev B) pp. 1–30, AMP Incorporated Harrisburg, PA, dated 1979.

* cited by examiner

*Primary Examiner*—Lincoln Donovan
*Assistant Examiner*—Nhung Nguyen

(57) ABSTRACT

An electrical circuit breaker (12) for mounting in an electrical distribution panel (10) comprises a dielectric housing (14) having a switch mechanism compartment (20) and an insulation-displacement connector assembly compartment (24), an electrical contact (48) on the housing for electrical connector to an electrical bus member in the electrical distribution panel, a temperature-sensitive switch mechanism (22) in the switch mechanism compartment and having a spring-biased contact (44) electrically connectable with the electrical contact, and an insulation-displacement connector assembly (26) in the insulation-displacement connector assembly compartment including an insulation-displacement contact (26*a*) electrically connected to the temperature-sensitive switch mechanism and for electrically connecting an insulated electrical wire thereto and an insulated movable actuator (26*b*) mounted in the housing for moving the insulated electrical wire from a wire-receiving position in the insulation-displacement contact to an electrical-connection position therein.

6 Claims, 6 Drawing Sheets

ELECTRICAL CIRCUIT BREAKER HAVING AN INSULATION DISPLACEMENT CONNECTOR ASSEMBLY

The Applicant is provisional of No. 60/118,251 Feb. 2, 1999.

FIELD OF THE INVENTION

The present invention relates to electrical circuit breakers mounted in an electrical distribution panel and more particularly to electrical circuit breakers having insulation displacement connector assemblies for electrically connecting electrical wires thereto.

BACKGROUND OF THE INVENTION

When electrical building wiring is electrically connected to electrical supply wiring, it is typically done through circuit breakers to limit electrical current overloads on the building wiring. The electrical connections are typically made by way of screws on the circuit breakers. In order to perform the installation, the installer must first strip the insulation off from the electrical wiring to expose the inner copper conductor. The inner conductor is then inserted under the screw and it is then screwed down tightly to secure the conductor on the circuit breaker.

Electrical circuit breakers are physically mounted into an electrical distribution panel and electrically connected to current-carrying electrical wires usually made of copper conductors insulated with thermoplastic material. The procedure to make the electrical and physical connection involves: removal of the insulating material to expose the copper conductor, straightening the copper conductor, loosening the screw on the circuit breaker, placing the copper conductor under the screw head on the circuit breaker, and tightening the screw to compress the copper conductor under the screw head.

Care must be exercised in each of these steps to insure a good electrical and physical connection. The insulating material must be removed in a manner as not to nick or cut the copper conductor, because nicking or cutting the copper conductor weakens the mechanical strength of the conductor and also creates a local spot of increased electrical resistance because of the copper material being removed. This local spot of increased resistance will result in a local hot spot in temperature as electrical current flows through the conductor. Also, it is critical to the electrical connection to make sure that none of the insulating material is caught between the screw and the circuit breaker. Having the insulative material captive under the screw decreases the terminating force that can be applied to the conductor and thereby increases the electrical resistance of the connection. The screw must be made tight in order to provide the best electrical connection, but over-tightening the screw will strip the threads of the screw or the threads of the circuit breaker, resulting in a poor electrical connection.

Increases in resistance, caused by poor connections as described above, result in increases in temperature during current flow. This situation could lead to the ignition of flammable materials that are within close proximity.

U.S. Pat. No. 5,006,077 discloses telescoped metal cylinders with one of the metal cylinders being rotatable relative to the other of the metal cylinders by means of a dielectric actuator secured to the rotatable metal cylinder in order to terminate an electrical wire in an insulation-displacement slot.

U.S. Pat. No. 5,496,192 discloses a similar insulation-displacement connector with stacked cylindrical insulation-displacement contacts that terminate electrical wires in insulation-displacement slots thereof by movable dielectric actuators.

The insulation-displacement connectors of these patents are used to interconnect telephone lines and not in connection with circuit breaker switch mechanisms.

SUMMARY OF THE INVENTION

The present invention is directed to an electrical circuit breaker for mounting in an electrical distribution panel comprising a dielectric housing, an electrical contact on the housing for electrical connection to an electrical bus member in the electrical distribution panel, a temperature-sensitive switch mechanism in the housing having a spring-biased contact electrically connectable with the electrical contact, and an insulation-displacement connector assembly electrically connected to the temperature-sensitive switch member having an insulation-displacement contact for electrically connecting an insulated electrical wire thereto and an insulated movable actuator mounted in the housing over the insulation-displacement contact for moving the insulated electrical wire from a wire-receiving position in the insulation-displacement contact to an electrical-connection position therein.

BRIEF DESCRIPTION OF THE DRAWING

An embodiment of the present invention will now be described with reference to the accompanying drawings in which.

DETAILED DESCRIPTON OF THE INVENTION

Figure 1:
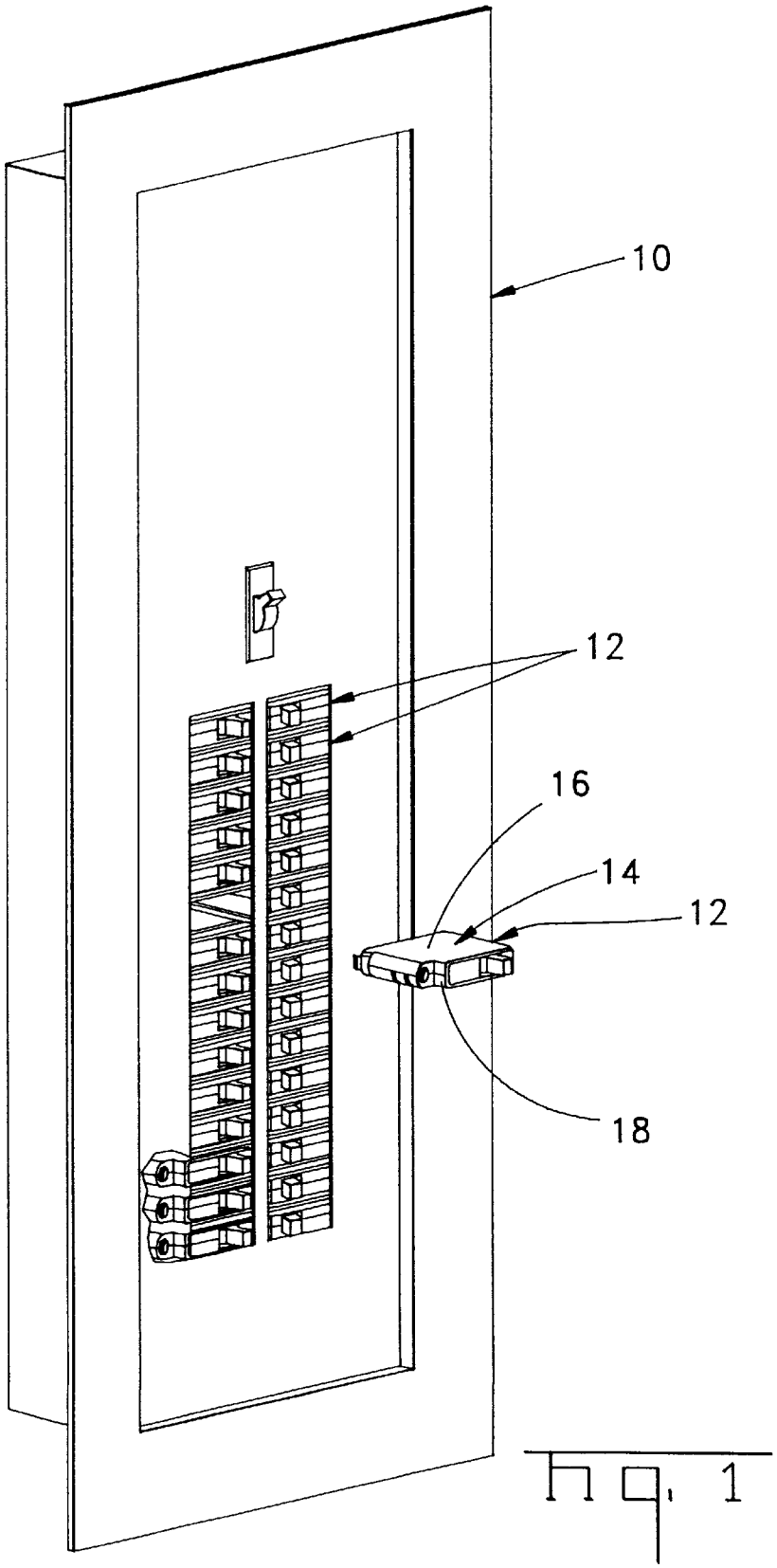
FIG. 1 is an electrical distribution panel having rows of electrical circuit breakers with an electrical circuit breaker exploded therefrom.

As shown in FIG. 1, an electrical distribution panel 10 of conventional construction contains rows of electrical circuit breakers 12 mounted therewithin with one of the electrical circuit breakers exploded therefrom. The electrical distribution panel 10 comprises a box configuration, and it is typically mounted onto a wall in a building with electrical supply wires in a conduit (not shown) electrically connected to electrical buses and a ground connection therein. Electrical building wires in conduits are also not shown.

Figure 2:
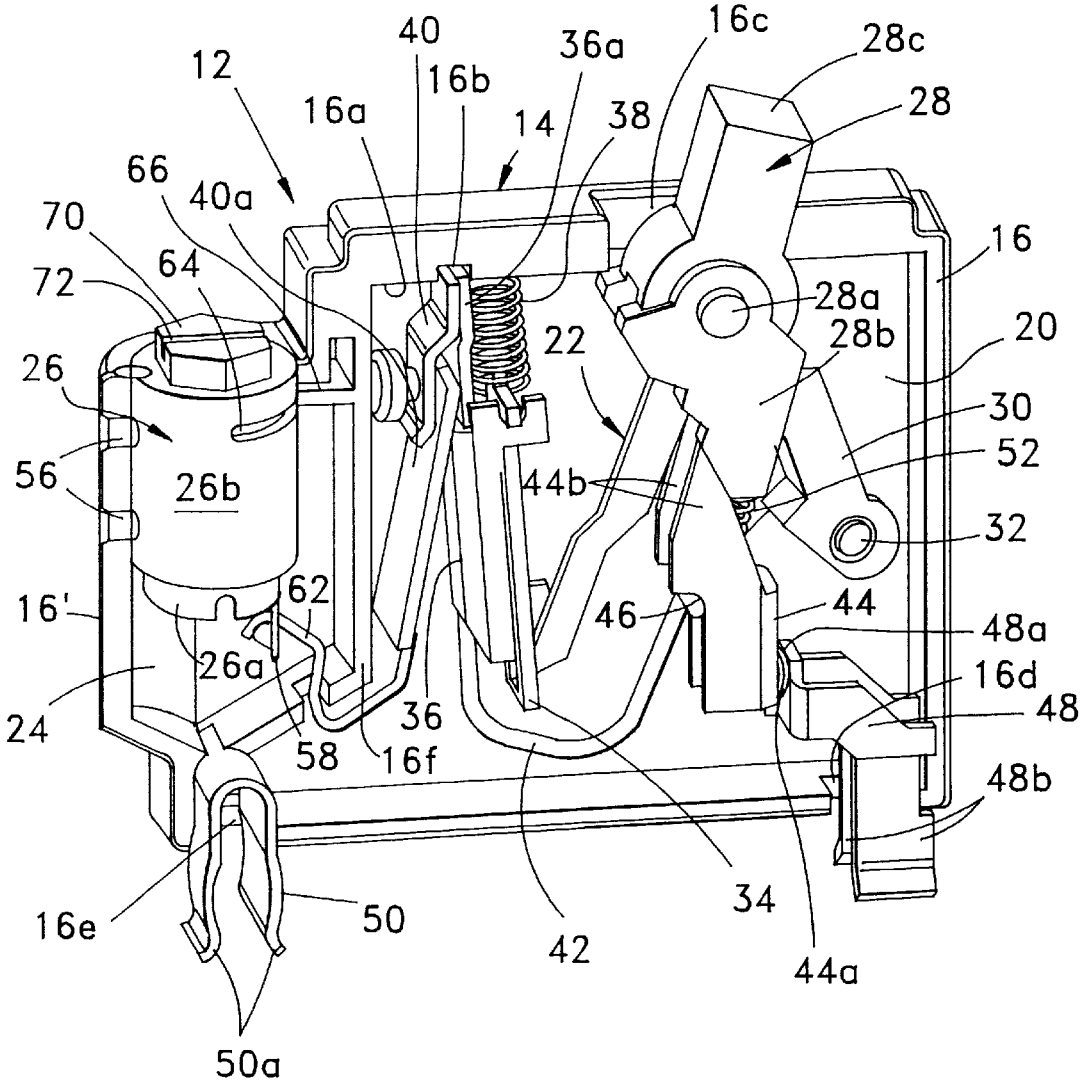
FIG. 2 is a view of the electrical circuit breaker with half of an insulating housing removed showing a temperature-sensitive switch mechanism and an insulation-displacement connector assembly.
Figure 3:
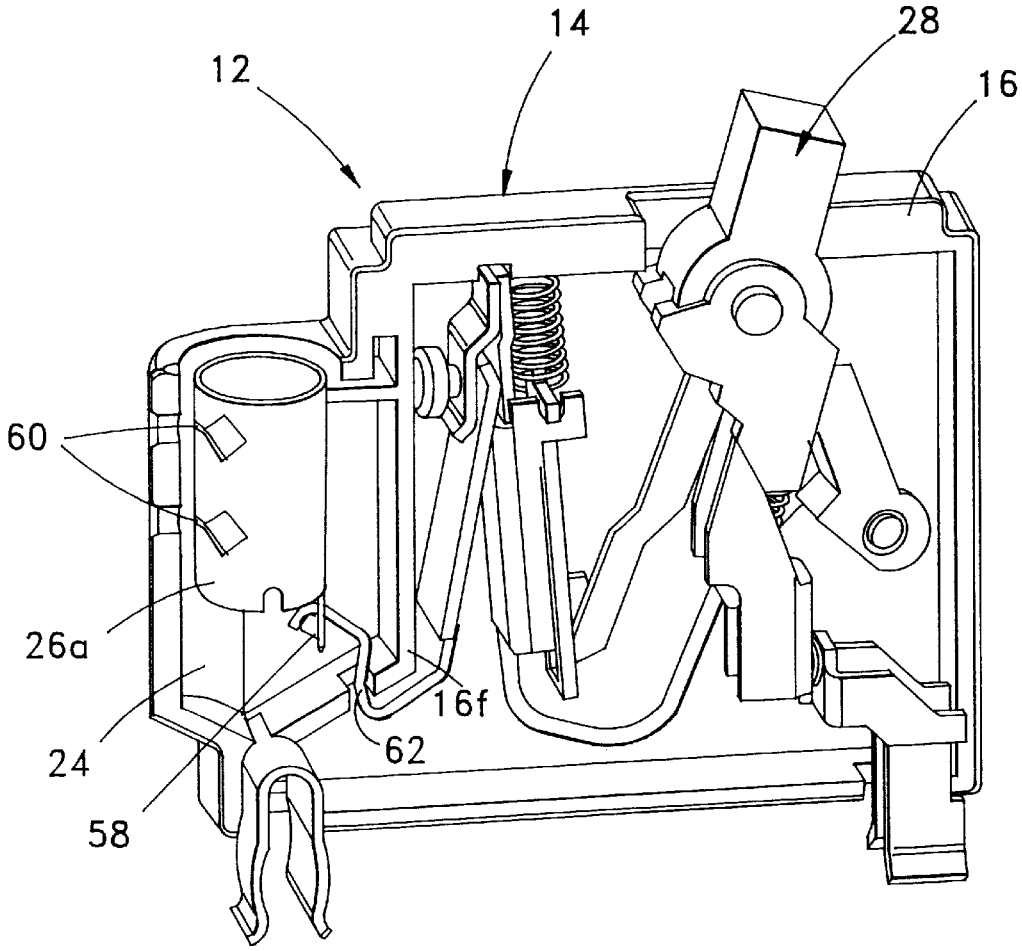
FIG. 3 is a view similar to FIG. 2 showing the insulation-displacement contact with an actuator in the form of a conductor-driving member removed therefrom.

Each of the electrical circuit breakers 12 as best seen in FIGS. 1–3 includes an insulation housing 14 which comprises mating housing members 16, 18 that are substantially mirror images of one another. Housing member 16 will be used to describe the mounting of a temperature-sensitive switch mechanism and an insulation-displacement connector assembly in housing 14.

Housing member 16 has a switch compartment 20 in which a conventional temperature-sensitive switch mechanism 22 is located and an insulation-displacement compartment 24 in which an insulation-displacement connector assembly 26 is located.

The temperature-sensitive switch mechanism 22 that is used in a circuit breaker is made by the Square D Corporation and it includes a dielectric operating member 28 pivotally mounted via pinions 28*a* in housing 14 between mating housing members 16, 18; a generally V-shaped lever 30 having a short leg pivotally mounted on an integral pin 32 of housing member 16 and an end of a long leg of lever 30 is engaged with a bight of a bimetallic element 34 pivotally mounted on a U-shaped member 36. A coil spring 38 extends between an inner upper surface 16*a* of an upper wall of housing member 16 and an upper end of bimetallic element 34. An upper end of leg 36*a* of member 36 is disposed in a recess 16*b* in upper surface 16*a* of housing member 16 along with an upper end of plate 40 containing an electrical contact 40*a*. An electrical wire 42 has one end electrically connected to member 36 and the other end is electrically connected to U-shaped electrical contact 44 that is pivotally mounted on an integral pin 46 of housing member 16. An electrical contact member 44*a* on the bight of electrical contact 44 is electrically connectable to an electrical contact member 48*a* on a bight of a U-shaped stationary contact 48 mounted in housing member 16. Legs 44*b* of contact 44 are engageable with stepped surfaces of respective legs 28*b* of operating member 28 which has a projection 28*c* disposed in recess 16*c* located in the upper wall of housing member 16. Spring contact members 48*b* extend from the respective legs of contact 48 through a recess 16*d* in a bottom wall of housing member 16. A U-shaped retention member 50 is mounted in housing member 16 with its spring legs 50*a* extending through a recess 16*e* in the bottom wall of housing member 16. A coil spring 52 has its ends respectively connected to lever 30 and contact 44.

Operating member 28 can be manually moved between an on and off position by engaging projection 28*c* and moving operating member to one or the other positions. As shown in FIGS. 2 and 3, the switch mechanism is in an on position with electrical contact members 44*a*, 48*a* being in electrical engagement. Movement of the operating member 28 to a position opposite to that shown in FIGS. 2 and 3 will cause pivotable electrical contact 44 to move in a clockwise direction thereby disconnecting contact members 44*a*, 48*a* from each other.

Circuit breakers 12 are held in position in the distribution panel 10 by spring contact members 48*b* of electrical contacts 48 springably and electrically engaging an electrical bus bar (not shown) in the distribution panel, and the legs 50*a* of retention members 50 springably engage a retention bar (not shown) in the distribution panel thereby mechanically retaining the circuit breakers in position in the distribution panel.

Figure 4:
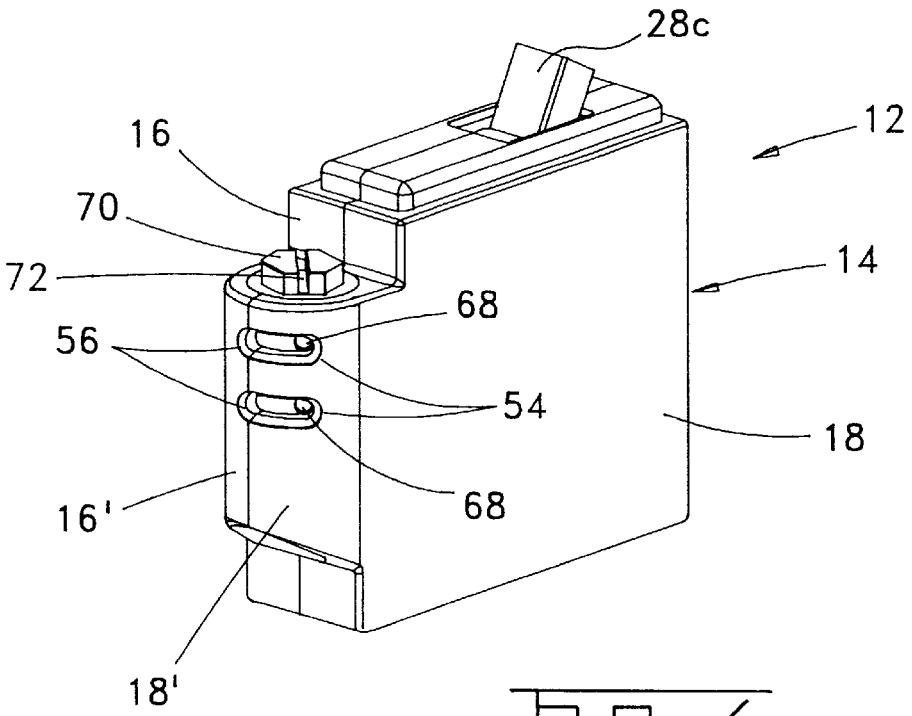
FIG. 4 is a perspective view of the electrical circuit breaker.
Figure 5:
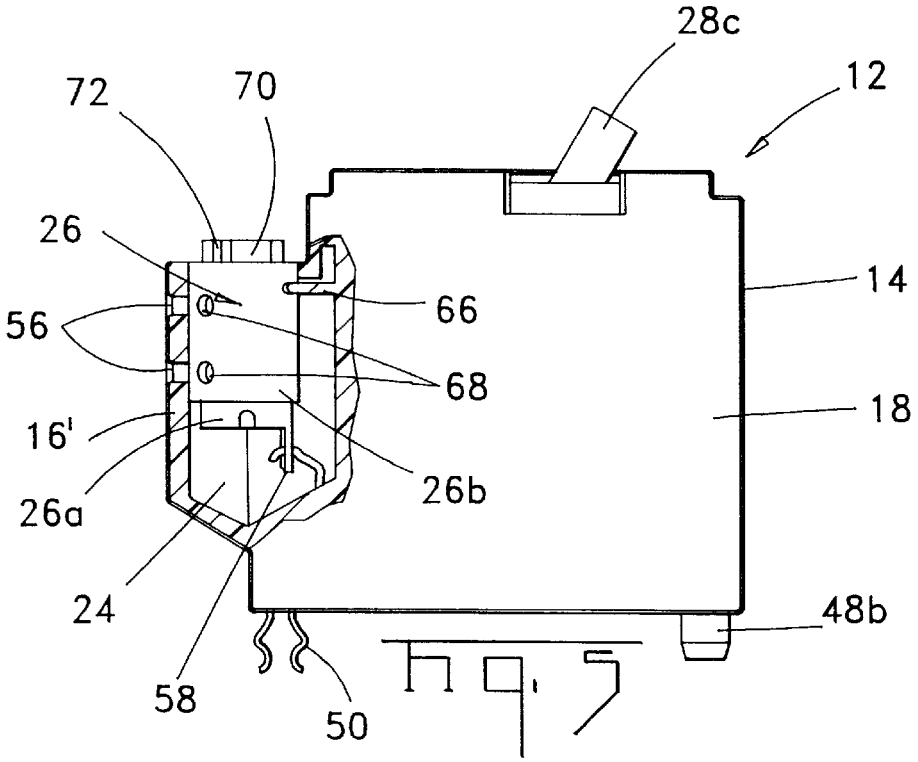
FIG. 5 is a side view of the electrical circuit breaker with part of the insulation housing removed showing the insulation-displacement connector assembly.

Housing members 16, 18 have arcuate sections 16', 18' extending outwardly from a left side thereof when viewing FIG. 4 so that when the housing members 16, 18 are secured together by rivets or the like (not shown), arcuate sections 16', 18' will form the insulation-displacement compartment 24 which will be open at its upper end. An internal wall 16*f* as shown in FIGS. 2 and 3 separates the switch compartment 20 from the insulation-displacement compartment 24.

Arcuate section 18' as shown in FIG. 4 has spaced elongated slots 54 extending thereacross and therethrough which mate with arcuate recesses 56 in arcuate section 16' when the housing members 16, 18 are secured together.

Figure 6:
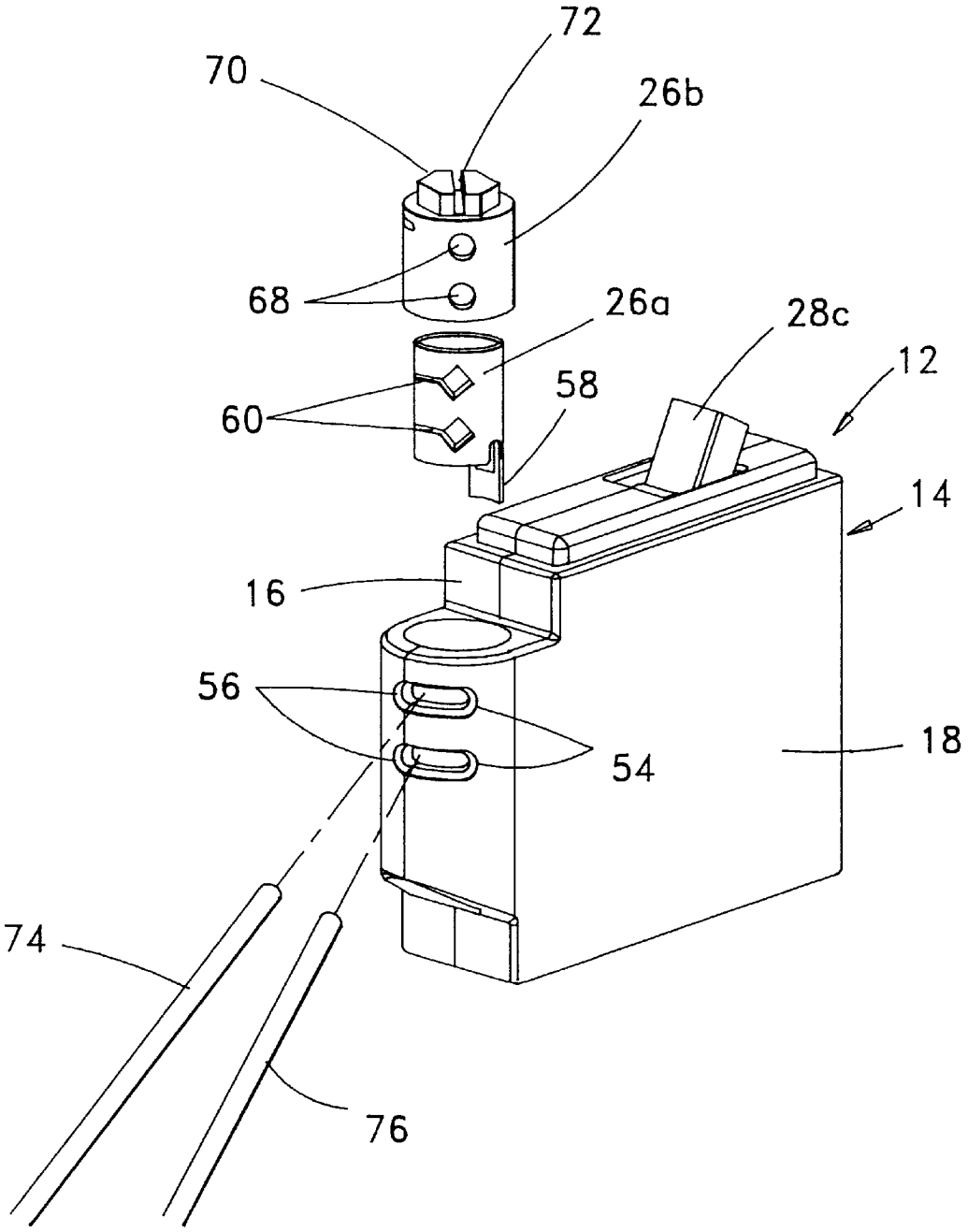
FIG. 6 is an exploded perspective view of the electrical circuit breaker and elements of the insulation-displacement connector assembly exploded therefrom.

Insulation-displacement connector assembly 26 comprises an insulation-displacement contact 26*a* and an actuator or conductor-driving member 26*b*. Insulation-displacement contact 26*a* is a metal cylinder having a projection 58 extending from a bottom end of the metal cylinder and spaced insulation-displacement slots 60 which have diamond-shaped apertures at one end thereof (see FIGS. 3 and 6). Insulation-displacement contact 26*a* is mounted in the insulation-displacement compartment so that the insulation-displacement slots 60 are aligned with elongated slots 54 and the ends of the insulation-displacement slots 60 opposite the diamond-shaped apertures are opposite arcuate recesses 56 in arcuate section 16'.

An electrical wire 62 has one end electrically connected to projection 58 and the other end is electrically connected to electrical contact 40*a*. Projection 58 preferably has an insulation-displacement slot therein to electrically connect the one end of the electrical wire 62 thereto.

Actuator 26*b* is a dielectric cylinder that movably is mounted over the insulation-displacement contact 26*a* as shown in FIG. 2. An elongated slot 64 is located in actuator 26*b* so that an end of extension 66 from internal wall 16*f* is disposed in elongated slot 64 thereby enabling actuator 26*b* to be mounted in the insulation-displacement compartment and to be movable relative to the insulation-displacement contact 26*a*. Wire-receiving holes 68 extend through actuator 26*b* and they are aligned with slots 54 in section 18'. A hexagonal member 70 with a slot 72 thereacross is located at an upper end of the actuator 26*b* so as to be engaged by a wrench or screwdriver to move actuator 26*b* relative to insulation-displacement contact 26*a*.

Figure 7:
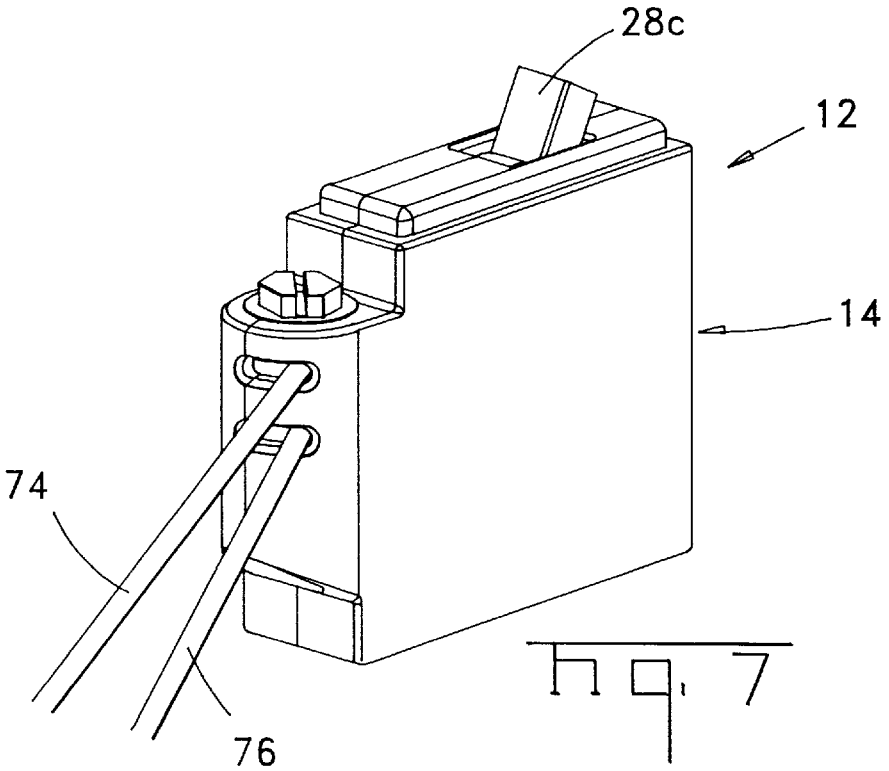
FIG. 7 is a perspective view of the electrical circuit breaker showing electrical wires positioned in the insulation-displacement connector assembly prior to being electrically connected to the insulation-displacement contact assembly.
Figure 8:
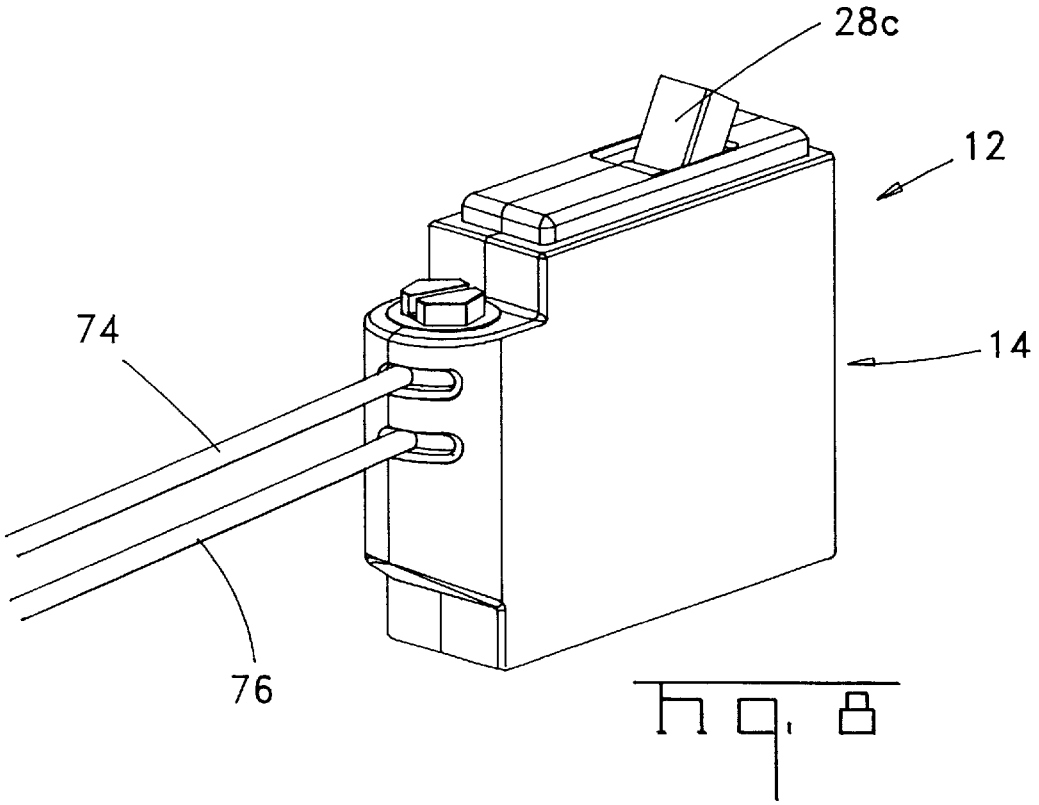
FIG. 8 is a view similar to FIG. 7 showing the electrical wires being electrically connected to the insulation-displacement connector assembly.

A selected circuit breaker 12 is electrically deactivated from electrical distribution panel 10 and insulated electrical wire 74 (FIGS. 6–8), which is a hot side of an electrical circuit, is inserted into one of holes 68 of the insulation-displacement connector assembly 26 through one of the elongated slots 54 in section 18' with the holes 68 being located adjacent the right hand ends of slots 54 as shown in FIG. 4. Wire 74 also extends through the diamond-shaped aperture of the selected insulation-displacement slot 60. A wrench can be used on the hexagonal member 70 and the actuator 26*b* is turned in a clockwise direction causing the insulating electrical wire 74 to be moved into the insulating-displacement slot 60 until the wire engages arcuate recess 56, which acts as a stop. The opposing edges of the insulation-displacement slot cut through the insulation of the wire 74 as the wire is moved therealong so that an electrical connection is made between a conductive core of wire 74 and insulation-displacement contact 26*a*.

Another insulated electrical wire 76 as a continuation of the electrical circuit to another electrical component can be simultaneously electrically connected via the insulation-displacement connector assembly as described above by inserting wire 76 in the other hole 68 of actuator 26*b*.

If desired, a screwdriver can be used instead of a wrench by inserting the blade of the screwdriver into slot 72 and moving the actuator 26*b* as described above.

In the event that excessive current appears on the wire 74 and/or 76, the bimetallic element 34 will release the long leg of the lever 22 therefrom causing spring 52 to move contact 44 so as to disconnect contact members 44*a*, 48*a* and move the operating member 28 to an off position thereby automatically disconnecting the electrical circuit.

As described above, a circuit breaker includes an insulation-displacement connector assembly that enables insulated electrical wires to be easily and readily electrically connected thereto without having to strip insulation from the electrical wires and using screws to electrically connect the wires to the temperature-sensitive switch mechanism therein.

What is claimed is:

1. An electrical circuit breaker for mounting in an electrical distribution panel, comprising a dielectric housing having a switch mechanism compartment and an insulation-displacement connector assembly compartment;

an electrical contact on the housing for electrical connection to the electrical distribution panel;

a switch mechanism in the switch mechanism compartment and having a spring-biased contact electrically connectable with the electrical contact; and an insulation-displacement connector assembly in the insulation-displacement connector assembly compartment, including an insulation-displacement contact electrically connected to the switch mechanism and for electrically connecting an insulated electrical wire thereto, and an insulated movable actuator mounted in the housing for moving the insulated electrical wire from a wire-receiving position in the insulation-displacement contact to an electrical-connection position therein.

2. An electrical circuit breaker as claimed in claim 1, wherein an internal wall is provided in the housing separating the switch mechanism compartment from the insulation-displacement connector assembly compartment.

3. An electrical circuit breaker as claimed in claim 2, wherein an extension is provided on the internal wall and is disposed in an elongated slot in the insulated movable actuator thereby mounting the insulation-displacement connector assembly in the insulation-displacement connector assembly compartment.

4. An electrical circuit breaker as claimed in claim 1, wherein the insulation-displacement contact has an insulation-displacement slot including an aperture at one end thereof, and the insulated movable actuator has a wire-receiving hole in alignment with the insulation-displacement slot.

5. An electrical circuit breaker as claimed in claim 4, wherein the housing has an elongated slot in alignment with the wire-receiving hole and the insulation-displacement slot.

6. An electrical circuit breaker as claimed in claim 1, wherein a retention member is mounted on the housing, and the retention member has spring legs for engagement with the electrical distribution panel.

* * * * *